United States Patent [19]

Hamu

[11] 4,409,749

[45] Oct. 18, 1983

[54] STRETCH FRAME

[76] Inventor: Kaino J. Hamu, 25142 Wandering La., El Toro, Calif. 92630

[21] Appl. No.: 300,220

[22] Filed: Sep. 8, 1981

[51] Int. Cl.[3] ..... D06C 3/08

[52] U.S. Cl. ..... 38/102.3; 160/378

[58] Field of Search ..... 38/102.1, 102.5, 102.7, 38/102.91, 102.3; 101/127.1, 128, 128.1; 403/19, 361; 160/378, 328; 106/392, 395

[56] References Cited

U.S. PATENT DOCUMENTS

| | | | |
|---|---|---|---|
| 190,189 | 5/1877 | Budd | 403/19 |
| 454,005 | 6/1891 | Parsons et al. | 160/378 |
| 2,191,292 | 2/1940 | Spece, Jr. | 403/19 X |
| 2,869,907 | 1/1959 | Deliso | 403/361 X |
| 3,226,861 | 1/1966 | Bird | 160/378 X |
| 3,414,994 | 12/1968 | Jaccard et al. | 101/127.1 X |
| 3,557,953 | 1/1971 | Hubach | 101/127.1 X |
| 3,987,835 | 10/1976 | Bloomfield | 101/127.1 X |
| 4,041,861 | 8/1977 | Alter | 101/127.1 X |

FOREIGN PATENT DOCUMENTS

| | | | |
|---|---|---|---|
| 2064712 | 7/1972 | Fed. Rep. of Germany | 101/127.1 |

*Primary Examiner*—Louis Rimrodt
*Assistant Examiner*—Andrew M. Falik
*Attorney, Agent, or Firm*—Boniard I. Brown

[57] ABSTRACT

A stretch frame for sheet material such as printing screen utilizes tensioning rollers to be secured to the sheet edges and then rotated to stress the sheet material. The rollers may be rotatably received within laterally opening channels in the frame and restrained against reverse rotation to release the sheet tension by a ratchet device extending along a substantial length of each roller. This construction insures that the printing screen or other web shaped material is rigidly held in place.

28 Claims, 6 Drawing Figures

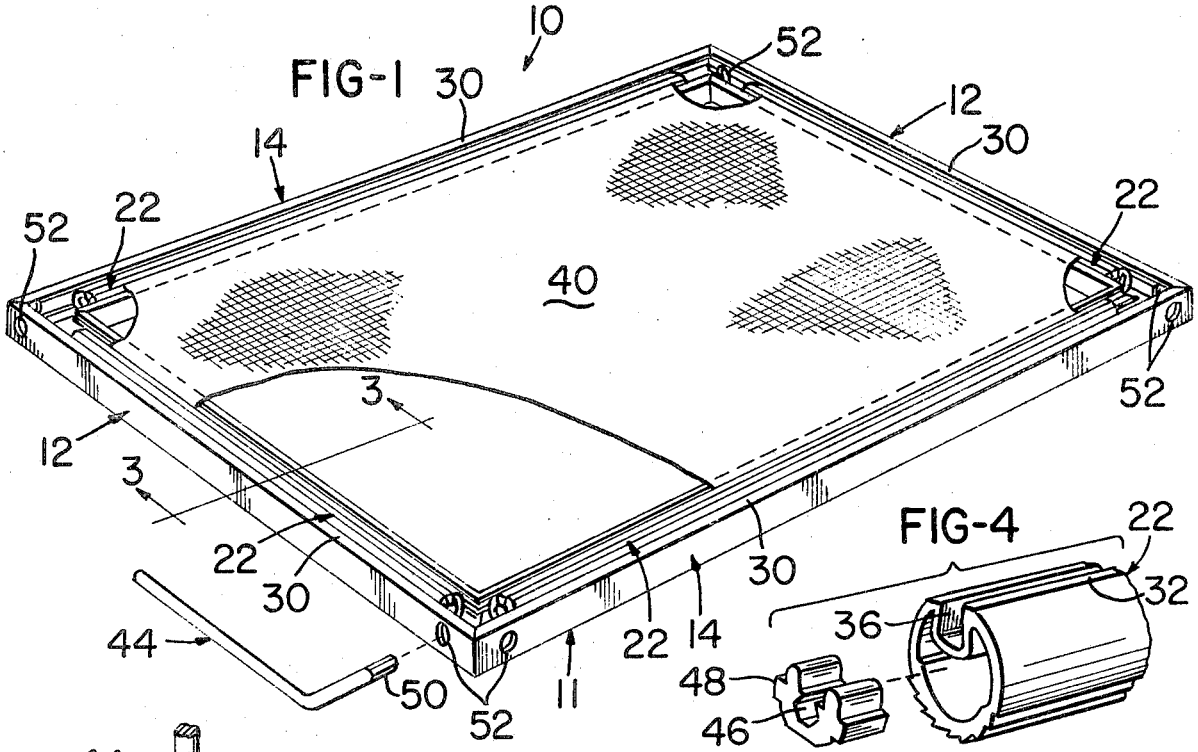
FIG-1
10
30
52
12
14
22
40
3
44
50
11
FIG-4
22
32
36
48
46
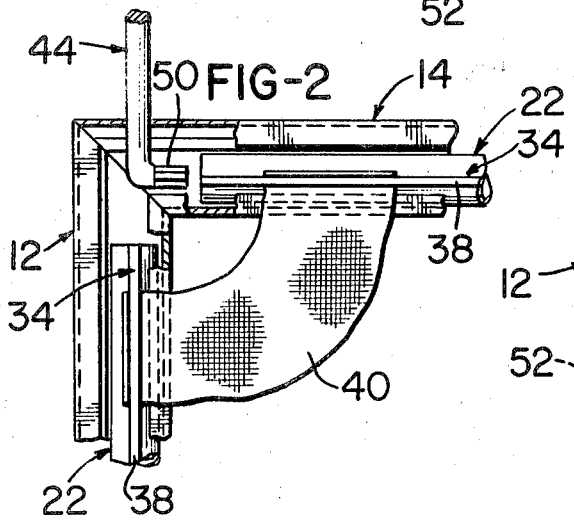
FIG-2
44
50
14
22
34
38
12
40
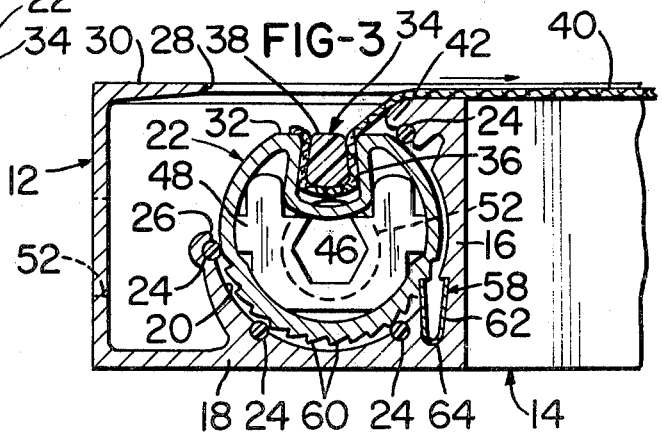
FIG-3
30
28
38
34
42
40
32
24
22
36
48
52
26
16
46
58
62
20
18
60
64
14
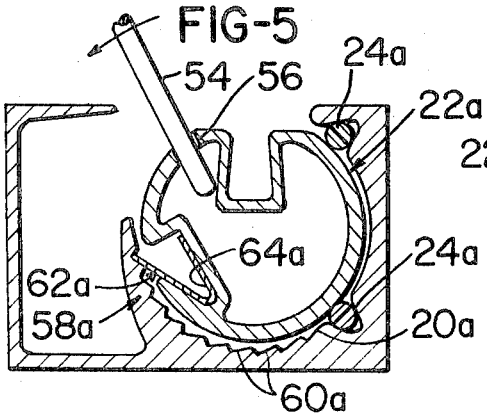
FIG-5
54
56
24a
22a
64a
62a
58a
20a
60a
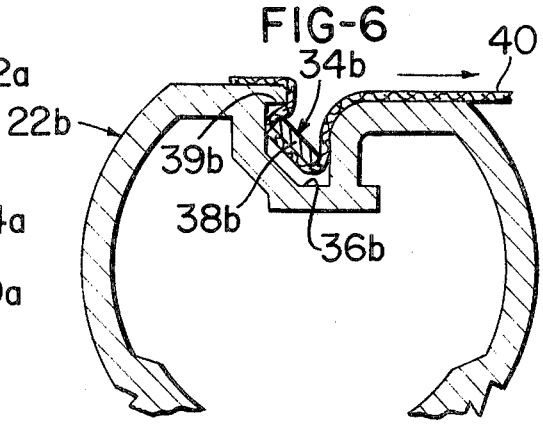
FIG-6
34b
40
22b
39b
38b
36b

STRETCH FRAME

BACKGROUND OF THE INVENTION

This invention relates generally to handling devices for web or sheet material. More particularly, the invention relates to a stretch frame for tensioning or stretching such materials edgewide.

As will appear from the following description, the stretch frame of the invention may be employed for various uses. Its primary application is in the silk screen printing industry for supporting the printing screen in a taut condition. In this industry, the frame is commonly referred to as a screen chase. The invention will be described in relation to its use as a silk screen chase.

In the silk screen printing process, also known as "silk-screening", the image to be printed is permanently formed on a printing screen by a photo etching process or the like which blocks the screen openings in a way which defines the image. Ink is then forced through the unblocked screen openings onto a printing surface to reproduce the image on the surface. Precise positioning of the screen is essential to achieve high quality results with good registration and resolution. Thus the screen must be maintained taut and in a stable position when the ink is forced through it. In some cases a stainless steel mesh screen has been utilized to minimize stretching. Nylon screens are now more commonly used because they are less expensive. The use of relatively elastic nylon makes it even more important than previously to provide a structure which will maintain the screen in a stable taut condition.

A variety of stretch frames or screen chases for this purpose are known. This invention is connected with frames of this type which use tensioning rollers which grip the screen edges and are rotated to stress the screen. Some early frames of this kind fail to securely grip the silk screen because they utilize screen tensioning rollers which grip the screen edges only at spaced locations. A solution to this problem was provided by the "keystone" structure, also referred to as an anchor bar structure, described in the applicant's earlier U.S. Pat. No. 3,962,805. Other frame improvements are described in the applicant's U.S. Pat. Nos. 3,601,911; 3,482,343; 3,553,862 and 3,608,854 and a pending application Ser. No. 132,389 U.S. Pat. No. 4,338,860 which was filed on Mar. 21, 1980. Roller anti-rotation means in the form of ratchet constructions for holding stretch frame rollers against reverse rotation to release the sheet tension are described in U.S. Pat. No. 3,908,293. These particular ratchet constructions act only on the roller ends and, for this reason, provide inadequate support for the roller.

A primary object of the invention is to provide an improved stretch frame for silk screening and other applications.

Another object of the invention is to provide an improved screen chase which will positively hold the printing screen so as to prevent its movement during the printing process.

Yet another object of the invention is to provide an improved stretch frame or screen chase which is more durable than the frames generally available prior to this time.

Still another object of the invention is to provide an improved stretch frame or screen chase which is more simple in construction than the frames generally available.

SUMMARY OF THE INVENTION

The foregoing objects and other objects and advantages which shall become apparent from the detailed description of the presently preferred embodiment are attained in a stretch frame which includes tensioning rollers with means for gripping the edges of the sheet material to be stressed, preferably along the entire lengths of the edges. These rollers are turned or rotated about their central axes in directions to wind the sheet material on the rollers and thereby stress the sheet material edgewise. The silk screen printing chase of the invention, which is also referred to herein as a stretch frame, has four rollers located along the four sides, respectively, of a rectangular frame structure for biaxially stressing a printing screen in mutually perpendicular edgewise directions.

One important and novel feature of the invention involves the manner in which the rollers are rotatably supported. According to this feature, the rollers are effectively rotatably supported along at least a substantial portion of their length. In the preferred embodiment, for example, the rollers are effectively journalled within journal-bearing-like channels in the stretch frame. These channels open laterally to the normally upper side of the frame, that is the side which receives the sheet material to be stressed, to permit extension of the sheet edges through the open channel sides into gripping engagement with the rollers. These bearing channels may contain novel bearing elements in the form of low friction roller-like inserts extending lengthwise of and spaced circumferentially about the channels.

Each tensioning roller carries sheet gripping means for gripping the edges of the sheet material to be stressed. Preferably, these sheet gripping means extend the full length of each roller so as to be effective to grip the respective sheet edge along its full length.

Another important and novel feature of the invention resides in anti-rotation means for restraining or locking each tensioning roller against reverse rotation to relieve the tension in the sheet material being stressed. According to this feature, these anti-rotation means extend and act on substantially the full length of each roller so as to assure uniform stressing of the sheet material along the full length of the sheet edges. The preferred form of anti-rotation means is a ratchet mechanism.

Other features of the invention are concerned with the construction of the frame structure of the stress frame and with the manner of rotating the tensioning rollers.

BRIEF DESCRIPTION OF THE ACCOMPANYING DRAWING

FIG. 1 is a perspective view of a stretch frame, in this instance a silk screen chase, in accordance with the invention;

FIG. 2 is a fragmentary plan view of one corner of the stretch frame, illustrated in FIG. 1;

FIG. 3 is an enlarged sectional view taken along the line 3—3 in FIG. 1;

FIG. 4 is an enlarged fragmentary exploded perspective view of one end of the tensioning roller in FIG. 3;

FIG. 5 is a view similar to FIG. 3 illustrating an alternate stretch frame construction; and FIG. 6 is an enlarged section through a tensioning roller with a modified sheet gripping means.

DESCRIPTION OF THE PREFERRED EMBODIMENT

Referring now to FIGS. 1–4, there is shown a stretch frame 10 in accordance with the invention. The particular frame shown is a screen chase for silk screening. The chase 10 has a rectangular frame structure 11 comprised of frame members 12 and 14 disposed in a rectangular arrangement and welded or otherwise rigidly joined end to end at the corners of the arrangement to form a rigid open rectangular frame. Rotatably supported along at least a substantial portion of its length within each frame member is a sheet tensioning roller 22. Various bearing arrangements may be used for this purpose. In the preferred embodiment illustrated, each frame member 12, 14 has a hollow generally rectangular cross section and inner and normally bottom walls 16, 18 which are internally shaped to form a recess or channel 20 of generally semi-circular cross section extending lengthwise of the frame member and rotatably receiving the respective roller 22.

Roller 22 is effectively journalled along substantially its entire length in the channel 20 for rotation of the roller on its longitudinal axis. The channel and roller thus constitute, in effect, a journal bearing in which the roller is the journal and the channel is the bearing. The roller could contact the channel wall directly. Preferably, however, the roller is rotatably supported by several low friction rod-shaped bearing inserts 24 contained within recesses entering the inner wall of the channel. These inserts are preferably constructed of nylon (a trademark of the E. I. du Pont de Nemours Company of Wilmington, Del.). Each bearing insert 24 preferably extends the entire length of the roller 22. These inserts function to reduce friction between the channel wall and the roller, both of which are preferably aluminum alloy extrusions.

Each roller channel 20 opens laterally along the full length of its roller 22, to the normally upper side of the frame structure 11 through an upper side opening 26 in the wall of the channel and an opening 28 in the upper wall 30 of the respective frame member 12, 14. Each roller is insertable into and removable from its frame channel 20 by lateral movement of the roller through the corresponding channel and frame openings 26, 28. In this regard, it will be seen in FIG. 3 that the channel wall between the two uppermost bearing inserts 24 which bound the channel side opening 26 extends about the roller 22 for slightly more than 180°. The roller has a flat side 32. The cross-sectional dimension of the roller between this flat side and its opposite side is made slightly less than the chard distance between the two upper bearing channel inserts, just mentioned. The upper frame member opening 28 has a width exceeding the roller diameter. Accordingly, each roller 22 may be inserted laterally into and removed laterally from its channel 20 by rotatably positioning the roller so that its narrow dimension (between its flat side 32 and opposite side) parallels the chord dimension between the two upper bearing inserts. While the bearing channels 20 are continuous from end to end, they could be interrupted at intervals so as to constitute, in effect, a plurality of spaced, axially aligned journal bearings which together rotatably support the roller along a major portion of its length.

Each tensioning roller 22 has sheet gripping means 34, preferably extending the full length of the roller. The particular gripping means illustrated is of the kind described in U.S. Pat. No. 3,962,805 and includes a longitudinal, laterally opening cavity 36 in the roller loosely receiving a gripping bar 38, the cavity and bar are tapered in cross-section as shown, to grip a sheet in the manner illustrated in FIG. 3.

Considering the operation of the stretch frame as screen chase 10 as thus far described, a rectangular piece of sheet material 40 to be stressed, such as a silk screen, is placed across the top of the stretch frame or screen chase 10 in the manner shown in FIG. 1. The sheet edges are then inserted through openings 28 in the frame members 12, 14 and secured to the adjacent rollers 22 by the roller sheet gripping means 34. It will be understood that this attachment of the sheet edges to the rollers is accomplished by rotating the rollers (in the manner explained below) to expose their sheet gripping means 34 through their respective channel side openings 26 and then threading the sheet edges between the roller sheet gripping bars 38 and the walls of the gripping bar receiving recesses 36, as shown in FIG. 3.

The sheet material 40 is then stressed edgewise by turning or rotating the rollers 22 to wind the sheet material onto the rollers. The rollers are rotated counter clockwise as viewed in FIG. 3 so that the roller sheet gripping means 34, which are now located at the tops of the rollers, move toward the outer edge of the frame 11. This draws the sheet edges outwardly to stress the sheet material. As shown in FIG. 3, each inner frame member wall 16 has a rounded upper edge 42 over which the sheet material passes to the adjacent roller so as to avoid cutting or tearing of the material.

The rollers 22 are turned to thus stress the sheet material 40 by a wrench 44 insertable into sockets 46 in the roller ends. These sockets are formed in inserts 48 which are press fitted in the ends of the rollers, as depicted in FIG. 4. Wrench 44 has an end 50 which is shaped to complement the roller sockets 46 and is insertable into these sockets through access openings 52 in the frame members 12, 14. Conceivably, these openings may be large enough to permit edwise movement of the rollers 22 through the openings into and from their channels 20. FIG. 5 illustrates an alternative way of turning the rollers. In this case a lever or rod 54 is inserted into a transverse hole 56 in each roller through the top opening in the respective frame member. If each roller has a single turning hole 56, it is preferably located midway between the roller ends. Each roller may have more than one hole, of course.

Once the sheet material 40 is stressed, the tensioning rollers 22 must be restrained or locked against reverse rotation (i.e. clockwise rotation in FIG. 3) to release the tension in the material. Anti-rotation means 58 are provided for this purpose. The particular anti-rotation means illustrated comprises ratchet means including ratchet teeth 60 about the half of each roller diametrically opposite its sheet gripping means 34, i.e. the lower half of the roller, as the latter is viewed in FIG. 3.

Carried on each frame member 12 and 14 is a generally U-shaped spring pawl 62. One leg and the lower bend of the pawl engages a recess 64 in the frame member. The other pawl leg is spring biased into engagement with the ratchet teeth 60 on the adjacent roller 22. The pawl and the ratchet teeth preferably extend the full length of each roller.

It will now be understood that when the sheet material or screen 40 is stressed by rotating the rollers 22 in the manner explained, the anti-rotation means 58 act to lock the rollers against reverse rotation and thereby retain the screen under tension. Because the rollers are journalled in the frame 11 along their full length, and the sheet gripping means 34 and ratchet means 58 extend the full length of the rollers, the sheet material is relatively uniformly stressed in both edgewise directions and along the full length of its edge. The sheet material is released from the rollers 22 by pushing the roller sheet gripping bars 38 into their recesses 36 to free the sheet edges.

Referring again to FIG. 5, the sheet tensioning roller **22*a* is restrained against reverse (clockwise) rotation to release the sheet tension by modified anti-rotation ratchet means 58*a*. This modified ratchet means is similar to that in FIG. 3 except that the positions of the ratchet teeth 60*a* and the ratchet pawl 62*a* are reversed. That is to say, the ratchet teeth 60*a* are formed in the wall of the roller channel 20*a* and the pawl 62*a* is positioned in a recess 64*a* in the roller 22*a*. The roller is supported by only two bearing inserts 24*a* located generally diametrically opposite the pawl 62*a***. The spring load exerted on the roller by the pawl thus tends to hold the roller against the inserts.

FIG. 6 shows a tensioning roller **22*b* with modified sheet gripping means 34*b*. In this case, the gripping means compresses a flat strip-like gripping bar 38*b* contoured within a narrower gripping recess 36*b* with an undedcut shoulder 39*b* along its outer side. When the roller 22*b* is turned to stress the sheet material or sheet 40, the edges of the gripping bar 38*b* are forced against the shoulder 39*b* and the opposite inner wall of the recess 36*b***, as shown, to grip the sheet edge.

The inventor claims:

1. In a stretch frame from stressing sheet material edgewise, the combination comprising:

a sheet tensioning roller, a frame structure including bearing means engaging the external surface of said roller along a substantial portion of its length and rotatably supporting the roller for turning of the roller on its longitudinal axis, sheet gripping means on said roller for gripping an edge of said sheet material whereby rotation of said roller in one direction with the opposite edge of the material fixed to the frame stresses the material edgewise between said edges, and readily accessible means for rotating said roller.

2. The combination of claim 1, wherein:

said bearing means engages said roller surface along substantially the entire roller length.

3. The combination of claim 1, wherein:

said sheet gripping means extends along the major length of the gripped sheet edge.

4. The combination of claim 3, wherein:

said sheet gripping means comprises a gripping recess within the extending substantially the full length of said roller, and a sheet gripping bar within and substantially coextensive with said gripping recess.

5. The combination of claim 1, wherein:

said rotating means comprises an axial socket in one end of said roller for receiving a tool such as a wrench for turning the roller.

6. The combination of claim 1, wherein:

said rotating means comprises a laterally opening hole in said roller for receiving a tool such as a bar for turning the roller.

7. The combination of claim 1, wherein:

said frame structure includes a hollow frame member along one side of the frame structure, said bearing means comprises a bearing channel within and extending lengthwise of said frame member and rotatably receiving said roller in journal-bearing-like fashion, and said frame member and channel having openings through which said roller is insertable into and removable from said frame member.

8. In a stretch frame for stressing sheet material edgewise, the combination comprising:

a sheet tensioning roller, a frame structure including bearing means rotatably supporting said roller along a substantial portion of its length, said bearing means comprising journal bearing means journalling said roller, and said roller provides the bearing journal, and sheet gripping means on said roller for gripping an edge of said sheet material whereby rotation of said roller in one direction with the opposite edge of the material fixed to the frame stresses the material edgewise between said edges.

9. In a stretch frame for stressing sheet material edgewise, the combination comprising:

a sheet tensioning roller, a frame structure including bearing means rotatably supporting said roller along a substantial portion of its length, said bearing means comprising a bearing channel on said frame structure rotatably receiving said roller in journal-bearing-like fashion, and sheet gripping means on said roller for gripping an edge of said sheet material whereby rotation of said roller in one direction with the opposite edge of the material fixed to the frame stresses the material edgewise between said edges.

10. The combination of claim 9, wherein:

said bearing means further comprises bearing inserts in the wall of said channel rotatably supporting said roller.

11. The combination of claim 9, including anti-rotation means for restraining said roller against reverse rotation comprising ratchet teeth on the wall of said channel and substantially coextensive with said roller, and a yieldable ratchet pawl on said roller engagable with and substantially coextensive with said ratchet teeth.

12. In a stretch frame for stressing sheet material edgewise, the combination comprising:

a sheet tensioning roller, a frame structure including a hollow frame member along one side of the frame structure, bearing means rotatably supporting said roller along a substantial portion of its length comprising a bearing channel within and extending lengthwise of said frame member and rotatably receiving said roller in journal-bearing-like fashion, said frame member and channel having openings through which said sheet material is insertable into gripping engagement with said roller sheet gripping means and sheet gripping means on said roller for gripping an edge of said sheet material whereby rotation of said roller in one direction with the opposite edge of the material fixed to the frame stresses the material edgewise between said edges.

13. In a stretch frame for stressing sheet material edgewise, the combination comprising:

a sheet tensioning roller, a frame structure including bearing means rotatably supporting said roller along a substantial portion of its length, sheet gripping means on said roller for gripping an edge of said sheet material whereby rotation of said roller in one direction with the opposite edge of the material fixed to the frame stresses the material edgewise between said edges, anti-rotation ratchet means extending along and acting on at least a major portion of the length of said roller for restraining said roller against reverse rotation.

14. The combination of claim 13, wherein:

said ratchet means comprises ratchet teeth on and substantially coextensive with said roller, and a yieldable ratchet pawl on said frame structure engagable with and substantially coextensive with said ratchet teeth.

15. In a stretch frame for stressing sheet material edgewise, the combination comprising a sheet tensioning roller, a frame structure including bearing means rotatably supporting said roller on said frame, sheet gripping means on said roller for gripping an edge of said sheet material, whereby rotation of said roller in one direction with the opposite sheet edge fixed to said frame stresses said sheet material edgewise between said edges, and anti-rotation means which comprises ratchet means operating between said frame structure and said roller along at least a substantial portion of the roller length for restraining said roller against reverse rotation.

16. The combination of claim 15, wherein:

said ratchet means comprises ratchet teeth on and substantially coextensive with said roller, and a yieldable ratchet pawl on said frame structure engagable with and substantially coextensive with said ratchet teeth.

17. The combination of claim 15, wherein:

said bearing means rotatably supports said roller along a substantial portion of its length.

18. The combination of claim 17, wherein:

said bearing means comprises a journal-bearing-like channel formation on said frame journalling said roller, said ratchet means comprises ratchet teeth on said roller and a ratchet pawl on said channel formation.

19. The combination of claim 17, wherein:

said bearing means comprises a journal-bearing-like channel on said frame journalling said roller, and said ratchet means comprises ratchet teeth on said channel formation, and a ratchet pawl on said roller.

20. A stretch frame for stressing sheet material edgewise, comprising:

a rectangular frame structure, sheet tensioning rollers along the four sides, respectively, of said frame structure, bearing means on said frame structure engaging the external surface of said rollers along a substantial portion of the length of each roller and rotatably supporting said rollers for turning of each roller on its longitudinal axis, sheet gripping means on said rollers for gripping edges of the sheet material, whereby rotation of said rollers in one direction stresses the sheet material edgewise, and readily accessible means for rotating said roller.

21. The stretch frame of claim 20, including:

anti-rotation means acting between said frame structure and each roller for restraining the roller against reverse rotation.

22. The stretch frame of claim 21, wherein:

said anti-rotation means and sheet gripping means for each roller extend along a major portion of the roller length.

23. The stretch frame of claim 22, wherein:

said bearing means for each roller comprises a journal-bearing-like channel formation on said frame structure journalling the respective roller along the major portion of its length, and said anti-rotation means for each roller comprises ratchet means including ratchet teeth and a ratchet pawl extending along the major portion of the length of the respective roller.

24. The stretch frame of claim 23, wherein:

said frame structure comprises hollow frame members along said frame sides respectively, and containing said rollers and bearing means, and said frame members have openings at one side of the frame through which the sheet edges are insertable into gripping engagement with said roller sheet gripping means.

25. The stretch frame of claim 20, wherein:

said readily accessible means comprising means at the ends of said roller accessible externally of said frame members by a tool for rotating the rollers.

26. The stretch frame of claim 20, wherein:

said readily accessible means comprising means on said rollers between their ends accessible through said frame member openings for receiving a tool for rotating the rollers.

27. The stretch frame of claim 20, wherein:

said frame structure comprises hollow frame members along said frame sides respectively, and containing said rollers and bearing means, and said frame members have openings at one side of the frame through which the sheet edges are insertable into gripping engagement with said roller sheet gripping means.

28. The stretch frame of claim 20, wherein:

said frame structure comprises hollow frame members along said frame sides respectively, and containing said rollers and bearing means, and said frame members and bearing means having openings through which said rollers are insertable into and removable from said frame members.

* * * * *